US005349792A

United States Patent [19]

Bayes

[11] Patent Number: 5,349,792

[45] Date of Patent: Sep. 27, 1994

[54] CAVITY TRAY

[75] Inventor: Ronald C. Bayes, Hertfordshire, England

[73] Assignee: Weldform Components Limited, Hertfordshire, United Kingdom

[21] Appl. No.: 156,391

[22] Filed: Nov. 22, 1993

Related U.S. Application Data

[63] Continuation of Ser. No. 821,697, Jan. 16, 1992, abandoned.

[51] Int. Cl.[5] ..... E04D 1/36

[52] U.S. Cl. ..... 52/62; 52/58; 52/412; 52/61

[58] Field of Search ..... 52/58, 62, 61, 94, 95, 52/96, 169.5, 412

[56] References Cited

U.S. PATENT DOCUMENTS

| | | | |
|---|---|---|---|
| 1,761,410 | 6/1930 | Rose | 52/412 |
| 1,970,326 | 8/1934 | Larson | 52/412 |
| 2,024,524 | 12/1935 | Jones | 52/412 |

FOREIGN PATENT DOCUMENTS

| | | |
|---|---|---|
| 1086226 | 10/1967 | United Kingdom . |
| 1202864 | 8/1970 | United Kingdom . |
| 1445713 | 8/1976 | United Kingdom . |
| 1488123 | 10/1977 | United Kingdom . |
| 2189523A | 10/1987 | United Kingdom . |
| 2212184A | 7/1989 | United Kingdom . |
| 1542630 | 3/1990 | United Kingdom . |

OTHER PUBLICATIONS

Lead Flashings, Weatherings and Roofings, Lead Delopment Association 1958.

*Primary Examiner*—Carl D. Friedman
*Assistant Examiner*—Winnie Yip
*Attorney, Agent, or Firm*—Flynn, Thiel, Boutell & Tanis

[57] ABSTRACT

The invention relates to a cavity tray for use in a cavity wall, comprising two spaced apart flanges each adapted in use to lie in or adjacent a respective skin of the wall, a connector connecting the two spaced apart flanges, and an arcuate transitional part leading to at least one flange whereby a super- or sub-posed damp-proof men, her may be adhered thereto with substantially no discontinuity.

12 Claims, 3 Drawing Sheets

CAVITY TRAY

This application is a continuation of U.S. Ser. No. 07/821,697, filed Jan. 16, 1992 now abandoned.

BACKGROUND OF THE INVENTION

The invention relates to cavity trays, that is preformed units that are used in buildings generally to bridge a gap in a cavity wall at, for instance, a stop end or change of level.

Such cavity trays are usually made from sheet material which is a combination of synthetic rubbers and thermoplastic polymer resins. The trays are intended to facilitate the damp-proofing of awkward junctions and avoid leakage paths, particularly where they are to be combined with a damp-proof course (DPC). The trays and DPC are usually bonded together using adhesive. The problem is that the trays usually have corners or nooks in which it is virtually impossible to lay a damp-proof course, however flexible that course is. The damp-proof course extends from one level to another leaving an unfilled space between it and the cavity tray along which water can pass so that the inner skin of the wall can become damaged.

It is accordingly an object of the invention to seek to mitigate this disadvantage.

According to one aspect of the invention there is provided a cavity tray for use in a cavity wall, comprising two spaced apart flanges each adapted in use to lie in or adjacent a respective skin of the wall, a connector connecting the two spaced apart flanges, and an arcuate transitional part leading to at least one flange whereby a super- or sub- posed damp-proof member may be adhered thereto with substantially no discontinuity.

The arcuate part is in use adapted to obviate abrupt changes direction in a direction from one flange to the other.

There may be a transitional part of arcuate configuration between each respective flange and the connector.

The tray may be made integrally in one piece.

One flange may extend in an opposite direction to the other and there may be a member extending at substantially 90° to the plane of the connector and the one flange.

One flange may extend in a direction of substantially 90° to the direction of the other flange, and there may be a member extending at substantially 90° to the plane of the connector and the one flange.

The member may terminate short of the arcuate part adjacent the other flange.

The tray may include a further flange extending a substantially 90° to the plane of the other flange to form therewith an "L"-configuration.

The one flange and the connector at least may be in two parts one of which is stepped with respect to the other, and the two parts may be connected by an integral wall member.

The other flange may be in two parts one of which may be stepped with respect to the other, the two parts being connected by the integral wall member.

The tray may comprise separate components secured together to form an integral unit by a high frequency welding process.

The tray may be integrally formed by injection moulding, or by vacuum forming.

The cavity tray may be formed from a mouldable composition comprising synthetic rubber and a thermoplastic polymer resin, which may comprise a fibre content.

According to a second aspect of the invention, there may be provided a damp-proof system of a structure, comprising a cavity wall, a damp-proof course extending across the cavity from the inner skin to the outer skin over a particular length, and a cavity tray as hereinbefore defined at at least one end of the length of damp-proof course whereby to obviate end leakage of moisture to the skin(s) of the wall.

There may be a cavity tray according to any of claims 1 to 15 at each end of the particular length of damp-proof course.

DETAILED DESCRIPTION

Figure 1:
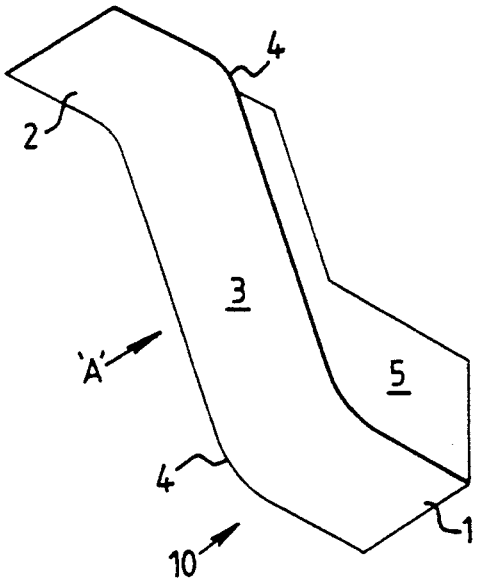
FIGS. 1–5 show perspective views from below or behind of various stop end cavity trays according to the invention, FIG. 5 showing a column stop end.

Referring to FIGS. 1–7 of the drawings, in which like parts are referred to by like reference numbers, there are shown cavity trays 10, 20, 30, 40, 50, 60, 70 each of which comprises two spaced apart flanges 1, 2, each flange being adapted in use to be in or adjacent a respective skin of the wall, in the embodiments the flange 1 being for use adjacent the outer skin of the wall and the flange 2 being for use adjacent the inner skin of the wall (not shown). The cavity trays 10–70 each have a connector 3 connecting the two spaced apart flanges 1, 2, and there is an arcuate transitional part 4 leading to at least one flange whereby a super- or sub-posed damp-proof course or member may be adhered thereto with substantially no discontinuity.

The transitional part 4 is therefore adapted to obviate abrupt changes in a direction from one flange 1 to the other flange 2, there being an arcuate transitional part 4 between the one flange 1 and the connector 3 and the other flange 2 and the connector 3.

Thus, in use, when cavity tray 10–70 is installed in a cavity wall, a flexible damp-proof course or member in the form of a flexible strip of damp-proof material can be secured to the cavity trays 10–70 by adhesive which is either spread over the cavity trays 10–70 or over the damp-proof course.

In either case, the damp-proof course can be laid smoothly in or under the transitional parts 4 so that the cavity trays 10–70 and damp-proof course adhere fully together over their whole overlapping area with no spaces or gaps therebetween, thereby leaving no unfilled space between the cavity trays 10–70 and the damp-proof course.

The damp-proof course can be "smoothed" into the curved transitional part 4 to effect this fully adhered union. Moreover, the arcuate transitional parts 4 allow for flexibility or adjustability of the trays 10–70 to allow for variations in skin heights in a wall and over obstructions such as window frames and the like, the arcuate parts 4 allowing for a smooth adjustment of the relative dispositions of the first flange 1 and the connector 3 and other flange 2 and the connector 3.

Figure 2:
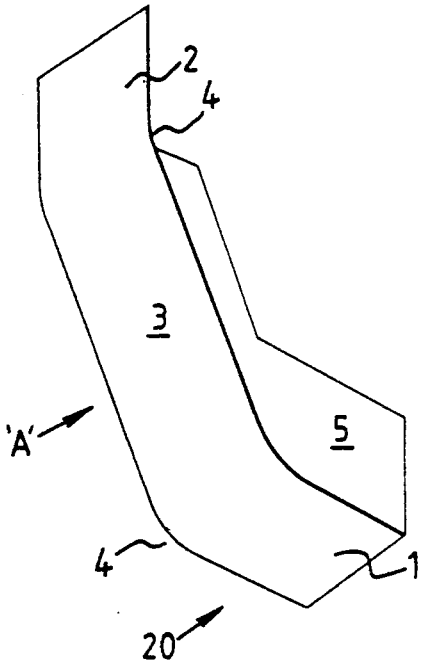
Figure 3:
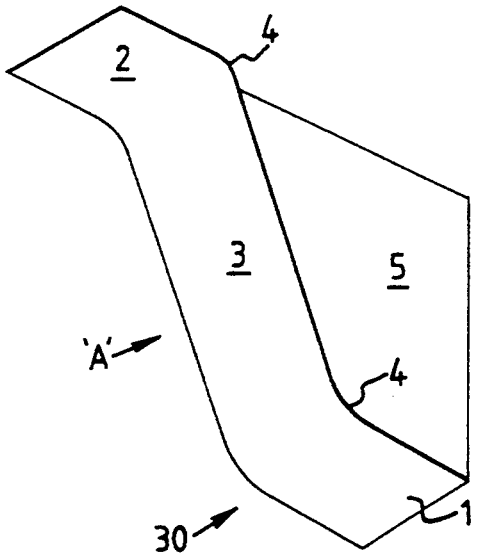

Referring now to the embodiment of FIGS. 1 to 5, they respectfully show a stop end cavity tray 10, 20, 30, 40 or 50 in which there is a member or end wall of upstand flange 5 which extends at substantially 90° to the plane of the connector 3 and to the plane of the one flange. In FIG. 1 and 2 the end wall 5 is of generally L-shape. In FIG. 1 to 4, the upper (as viewed) edge of the end wall 5 joins the connector 3 just below the start (lower end as viewed) of the radius of upper (as viewed, and as used) arcuate transitional part 4. This is to permit the adjustability already referred to herein, that to allow the flexing or folding of the cavity tray 10–50 about the arcuate transitional parts 4 when it is being installed in a damp-proof system in a cavity wall.

Figure 5:
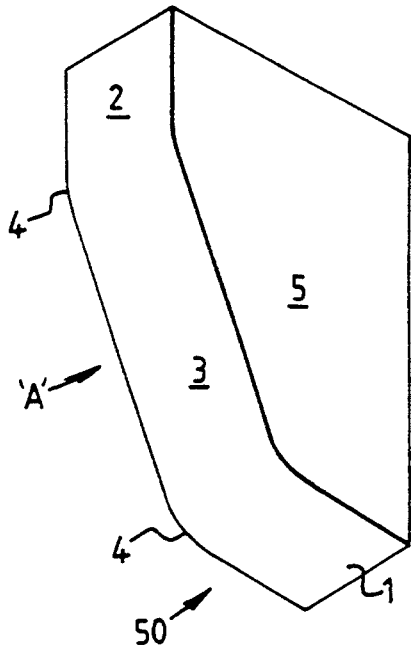

In FIG. 5, the end wall 5 extends from the free edge of the one flange 1 to the free edge of the other flange 2, but in this case too, the arcuate parts 4 allow flexibility during installation.

Figure 4:
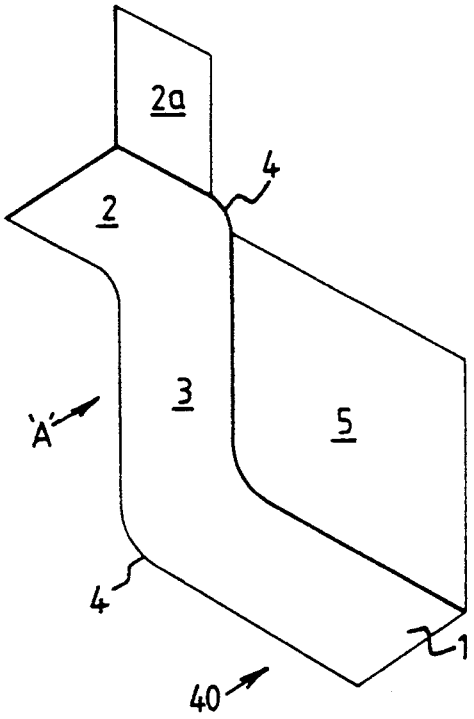

In FIG. 4 there is an additional flange 2*a* upstanding from the other flange 2, on the same side thereof as the end wall 5.

In all of the embodiments of FIGS. 1 to 5, there is only one end wall 5 welded into the radius 4, so the cavity tray 10–50 is open on side "A" looking into the tray in a direction towards the end wall 5.

Figure 6:
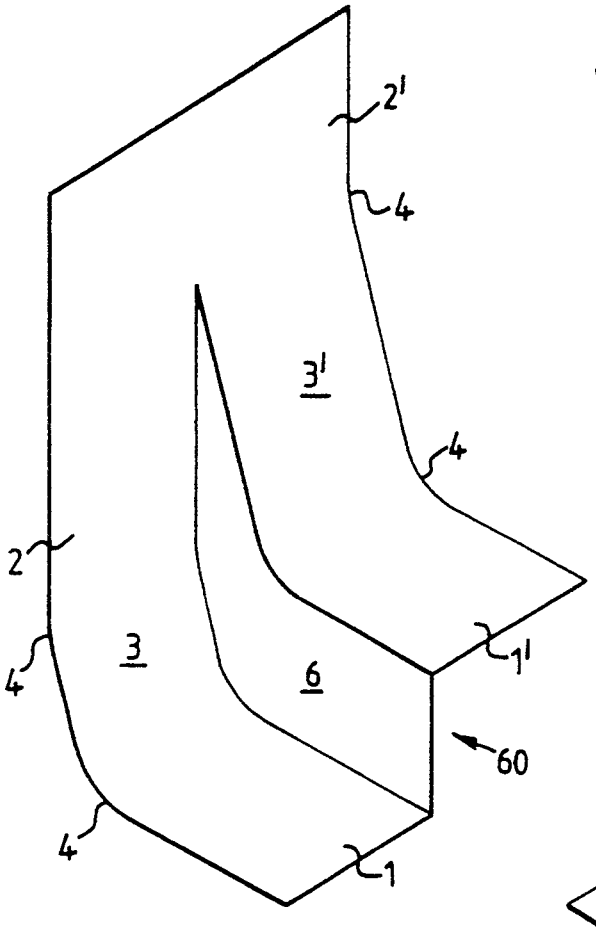
FIGS. 6 and 7 show from above or in front respectively change of level cavity trays according to the invention.
Figure 7:
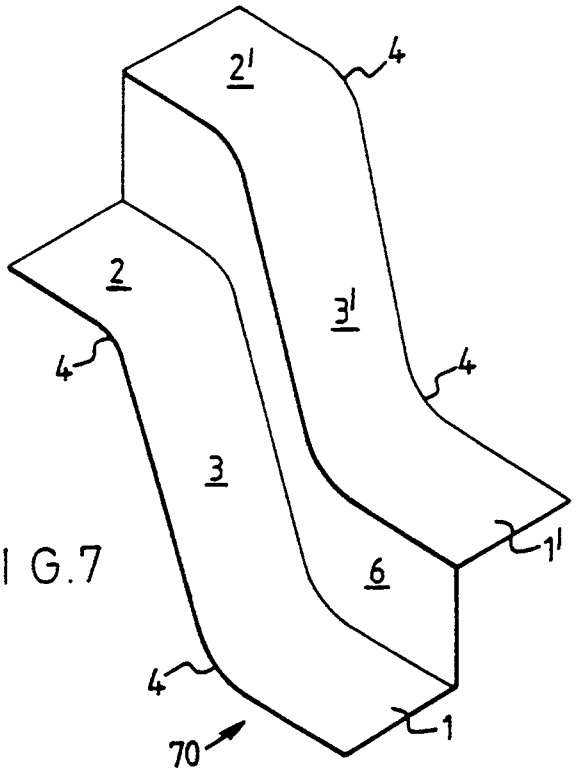

In the embodiments of FIGS. 6 and 7, in which the view is into the tray 60 or 70 from in front and above, the one flange 1 and connector 3 (FIG. 6) or the one flange 1, the connector 3 and the other flange 2 (FIG. 7) are in two parts 1, 1', 2, 2', and 3, 3' which are stepped with respect to one another and are connected by an integral vertical (in use) wall member 6 so as to provide a continuous integral cavity tray 60, 70 which can be used in systems where there is a change of level, for example of brickwork in a particular skin of a wall.

Figure 8:
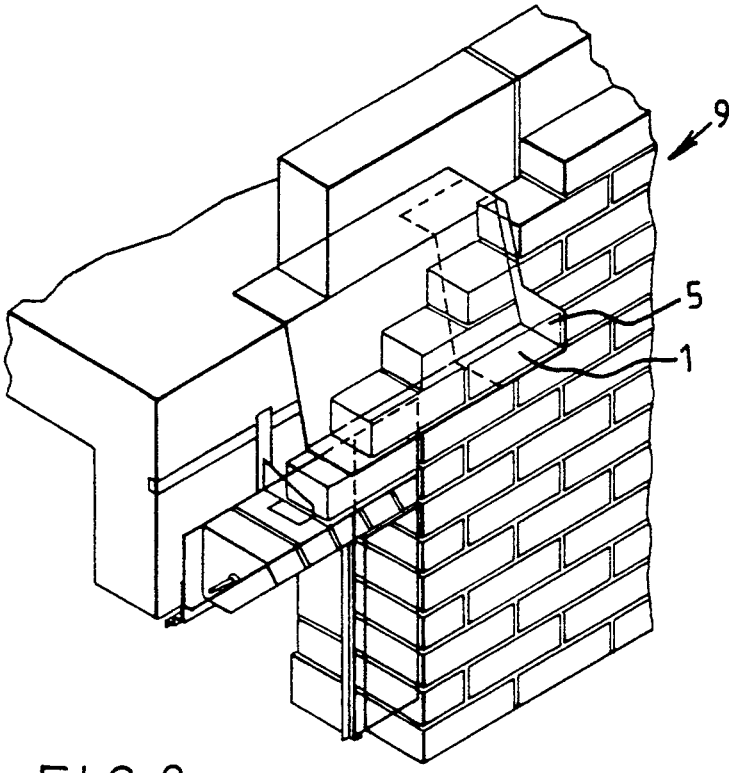
FIGS. 8 and 9 show respectively schematic view of damp-proof course systems incorporating cavity trays of the invention.
Figure 9:
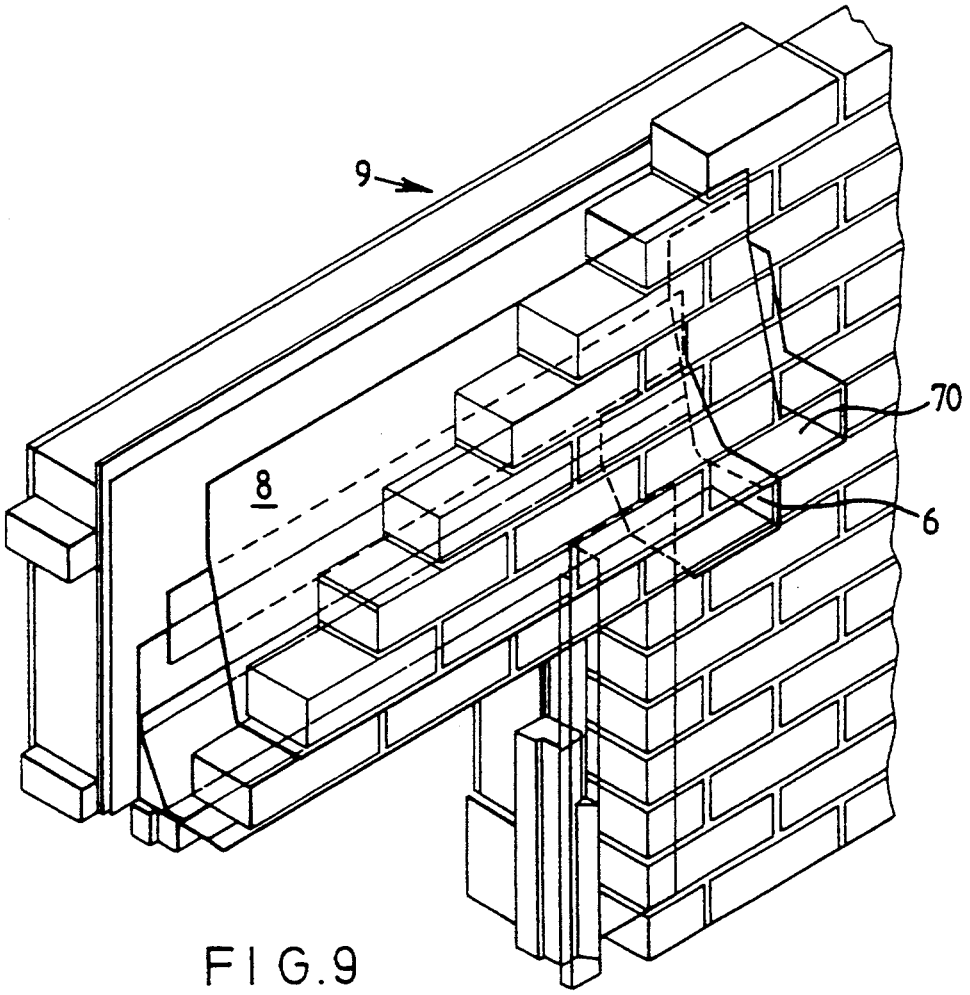

FIGS. 8 and 9 respectively show use of cavity trays according to the invention in damp-proof systems, the cavity tray being situated at the end of a particular length of damp-proof course 8 in a cavity wall 9, which damp-proof course 8 is received in the cavity tray up to the end wall 5 (FIG. 8) or wall member 6, (FIG. 9).

In every embodiment, the cavity tray 10-70 is made as one integral member from components which are secured together as by high frequency welding, or are made by a suitable forming method such as injection moulding or vacuum forming. The material used may be a mouldable synthetic rubber and thermoplastic polymer resin composition, or any suitable non-metallic material. The resin may include a fibre content, for example a mineral fibre.

I claim:

1. A cavity tray disposed in a gap between and engaged with inner and outer skins of a building wall, the cavity tray comprising:

a continuous one-piece flexible body constructed of thin sheet-like non-metallic material;

said body having sheet-like and substantially planar upper and lower flange parts disposed at opposite extremities of the body and disposed in their entireties in vertically and laterally spaced relation and engaged with the respective inner and outer skins of the building wall, said lower flange part extending generally horizontally and fixedly disposed within the outer skin of the wall;

said body including an inclined flat and elongated sheet-like intermediate part extending vertically and laterally between and interconnected to said upper and lower flange parts, said intermediate part extending in angled relation relative to both of said upper and lower flange parts;

said body further including a lower arcuately elongate sheet-like transitional part integrally and directly located between said intermediate part and said lower flange part, said lower transitional part having a vertically rounded and arcuately elongate profile as it extends between said lower flange part and said intermediate part, said lower transitional part having horizontal and vertical flexibility to allow the upper flange part to be positionally movably adjusted horizontally and vertically relative to the lower flange part to accommodate variations between the inner and outer skins, and said arcuately elongate profile being free of fold lines and abrupt directional discontinuities for permitting a damp-proof member adhesively bonded thereto so that there is substantially no discontinuity between the lower transitional part and the damp-proof member to prevent the development of a leakage path therebetween; and said body also including a flat sheet-like end wall part integrally secured to and projecting substantially vertically upwardly from concurrent side edges of said lower flange part, said lower transitional part and at least a portion of said intermediate part.

2. A cavity tray according to claim 1, wherein said upper flange part projects horizontally in the opposite direction from said lower flange part and is fixedly secured within said inner skin.

3. A cavity tray according to claim 2, wherein said upper flange part projects generally vertically for engagement with a facing surface of said inner skin.

4. A cavity tray according to claim 2, wherein the body includes an upper arcuately elongate sheet-like transitional part integrally and directly located between said intermediate part and said upper flange part, said upper transitional part having both horizontal and vertical flexibility to allow relative positional movement between the upper and lower flange parts to accommodate variations between the inner and outer skins.

5. A cavity tray according to claim 4, wherein the body terminates in upper and lower free edges which are both horizontally and vertically spaced apart and are respectively defined on said upper and lower flange parts.

6. A cavity tray according to claim 4, wherein an end wall flange is joined to one side edge of and projects generally perpendicularly upwardly from said upper flange part, said end wall flange being disposed on the same side of the body as said end wall part.

7. A cavity tray according to claim 2, wherein said lower flange and intermediate parts are each of a stepped configuration and include upper and lower portions which are horizontally and vertically spaced apart and are vertically joined by said end wall part.

8. A cavity tray according to claim 1, wherein the non-metallic material is a moldable synthetic rubber and thermoplastic polymer resin composition.

9. A cavity tray disposed in a gap between and engaged with inner and outer skins of a building wall, the cavity tray comprising:

a continuous one-piece flexible body constructed of a thin sheet-like non-metallic material which is deformed both vertically and horizontally to terminate in generally horizontally extending upper and lower free edges which are both vertically and laterally spaced apart;

said body having flat and substantially planar sheet-like upper and lower flange parts disposed in their entireties in vertically and laterally spaced relationship and secured to the respective inner and outer skins of the building wall, the lower flange part extending generally horizontally and being fixedly secured within the outer skin;

said body including an inclined flat and elongate sheet-like intermediate part extending vertically and laterally between and interconnecting said upper and lower flange parts, said intermediate part being disposed in angled relationship relative to both of said upper and lower flange parts and being positioned in the gap between the inner and outer skins;

said body also including an upper vertically arcuately elongate sheet-like transitional part integrally and directly joining said intermediate part and said upper flange part;

said body further including a lower vertically arcuately elongate sheet-like transitional part integrally and directly joining said intermediate part to said lower flange;

each of said upper and lower transitional parts having both horizontal and vertical flexibility to permit relative positional movement between said upper and lower flange parts to accommodate for positional variations between said inner and outer skins;

said lower transitional part having a smooth vertically rounded profile in the elongated direction from said lower flange part to said intermediate part so as to be free of fold lines and abrupt directional discontinuities so as to have smooth exterior surfaces for adhesive securement to a damp-proof course; and said body still further including a generally flat sheet-like end wall part integrally secured to and projecting substantially vertically upwardly from concurrent side edges of said lower flange part, said lower transitional part and at least a portion of said intermediate part.

10. A cavity tray according to claim 9, wherein said upper flange part projects horizontally in the opposite direction from said lower flange part and is fixedly secured within said inner skin.

11. A cavity tray according to claim 9, wherein said upper flange part projects generally vertically upwardly for engagement with a facing surface of the inner skin.

12. A cavity tray according to claim 9, wherein the non-metallic material is a moldable synthetic rubber and thermoplastic polymer resin composition.

* * * * *

UNITED STATES PATENT AND TRADEMARK OFFICE

CERTIFICATE OF CORRECTION

PATENT NO. : 5,349,792

DATED : September 27, 1994

INVENTOR(S) : Ronald Curtis BAYES

It is certified that error appears in the above-indentified patent and that said Letters Patent is hereby corrected as shown below:

Column 4, line 34; change "2" to ---1---.

line 52; change "2" to ---1---.

Signed and Sealed this

Seventh Day of February, 1995

Bruce Lehman

*Attest:*

BRUCE LEHMAN

*Attesting Officer*

*Commissioner of Patents and Trademarks*